United States Patent [19]

Benze

[11] Patent Number: 4,898,543

[45] Date of Patent: Feb. 6, 1990

[54] SELF-ALIGNING ELECTRICAL CONNECTOR

[75] Inventor: Everett L. Benze, Inglewood, Calif.

[73] Assignee: G & H Technology, Inc., Santa Monica, Calif.

[21] Appl. No.: 332,035

[22] Filed: Apr. 3, 1989

[51] Int. Cl.[4] ..... H01R 13/62

[52] U.S. Cl. ..... 439/374; 439/686

[58] Field of Search ..... 439/284, 290–295, 439/682, 686–690, 692, 693, 695–697

[56] References Cited

U.S. PATENT DOCUMENTS 4,274,700 6/1981 Keglewitsch et al. ..... 439/682

4,764,130 8/1988 DiClemente ..... 439/686

FOREIGN PATENT DOCUMENTS 3002515 7/1981 Fed. Rep. of Germany ..... 439/284

OTHER PUBLICATIONS

"Electrical Connector Assembly", by Uberbacher, IBM Technical Disclosure Bulletin, vol. 14, No. 9, Feb. 1972.

*Primary Examiner*—Gary F. Paumen

*Attorney, Agent, or Firm*—George J. Netter

[57] ABSTRACT

An electrical connector having plug and receptacle parts which can be mated with the parts oriented over a wide angular range relative to one another. The male contacts each include a pair of spaced apart, elongated blades which are received with a similarly dimensioned V-shaped slot in a female contact. A pair of spring loaded latch plates releasably lock the plug and receptacle together on mating.

4 Claims, 5 Drawing Sheets

SELF-ALIGNING ELECTRICAL CONNECTOR

The present invention relates to a releasable electrical connector, and, more particularly, to such a releasable connector that can be readily connected or disconnected by telerobotic devices or other means without requiring precise alignment or manipulation.

BACKGROUND

There are numerous situations in which an electrical connector consisting of mating first and second electrical parts must be engaged or disengaged under circumstances in which minimum amount of facility is required. For example, when an astronaut is suited for space environment activity (a so-called EVA suit) manipulative ability is impeded by virtue of the cumbersomeness aspects of the space insulated suit. There are also situations in which the electrical connector may be located in a spatially restricted area or in hazardous environment, so that connection and disconnection must be accomplished by telerobotic means. In the latter case, delicate manipulations and precise alignment may be practically impossible to obtain for the given circumstances, and even when obtainable necessitates accepting a range of angular and spatial tolerances.

It is, therefore, desirable to be able to provide an electrical connector which can be mated or unmated by EVA suited astronauts or telerobotic manipulators, in that the connector parts can be effectively interconnected or released even though a relatively substantial amount of misalignment exists between the parts and this can be achieved without producing damage to the connector. Moreover, it is desirable that such connectors have connector housings and backshells configured so that included electrical contacts cannot be inadvertently shorted out to the housing, broken, or damaged and that cable strain relief, and optimal connector electromagnetic interference protection is obtained.

SUMMARY OF THE DISCLOSURE

In accordance with the present invention there are provided first and second electrical connector parts which can be releasably secured together by moving them together along engagement directions extending throughout substantial angular ranges with respect to one another in either of two orthogonal planes. The connector part housings have generally rectangular cross-sections in order to accommodate receipt of flat cables through outer end portions. Included within the connector parts are electrical contacts, a male contact in one and a female contact in other, which are of special construction as to enable mating throughout substantial misalignment angular ranges without damaging the contacts or shorting them out to the parts housings.

The male contact is of generally rectangular plate-like construction having a double-bladed, forwardly tapered portion and an opposite or rear edge with a slot extending the full width. Outwardly extending mounting and securing flanges are centrally located on the plate major surfaces. The slotted edge is for receipt of a flat cable therein where it is soldered in place, for example, and the double-bladed portion effects electrical connection as will be described.

The female contact is also generally plate-like with a forward edge having a V-shaped slot or cavity extending therealong of such dimensions as to permit receiving the double-bladed tapered edge portion of the male contact therewithin. The cavity side walls include slots extending transversely from the edge for enhancing the spring-like resiliency of the wall material. The edge opposite the V-shaped cavity has an elongated slot for receiving a flat cable conductor where it is secured by soldering, for example.

The contacts are installed within insulative inserts in plug and receptacle connector housings, with open ends of the connector parts exposing, respectively, the double-bladed edge portion of the male contact and the V-cavity of the female connectors. The double-bladed edge portion of the male connector can be oriented throughout a substantial angular range of rotation about the edge as an axis and yet still permit ready receipt within the female contact edge cavity. Rotative orientation of the male contact about an axis orthogonal to the contact plate major surface is also acceptable over a considerable range while still allowing mating with a female contact.

The edge portions of the plug and receptacle housings facing one another during initial mating maneuvering are so dimensioned and formed as to guide the parts together even though initially substantially misaligned.

Spring-loaded locking means are provided on the exterior of one of the connector part housings for cooperating with means on the exterior of the other connector part housing to effect automatic locking and securing of the connector parts together.

DESCRIPTION OF A PREFERRED EMBODIMENT

Figure 1:
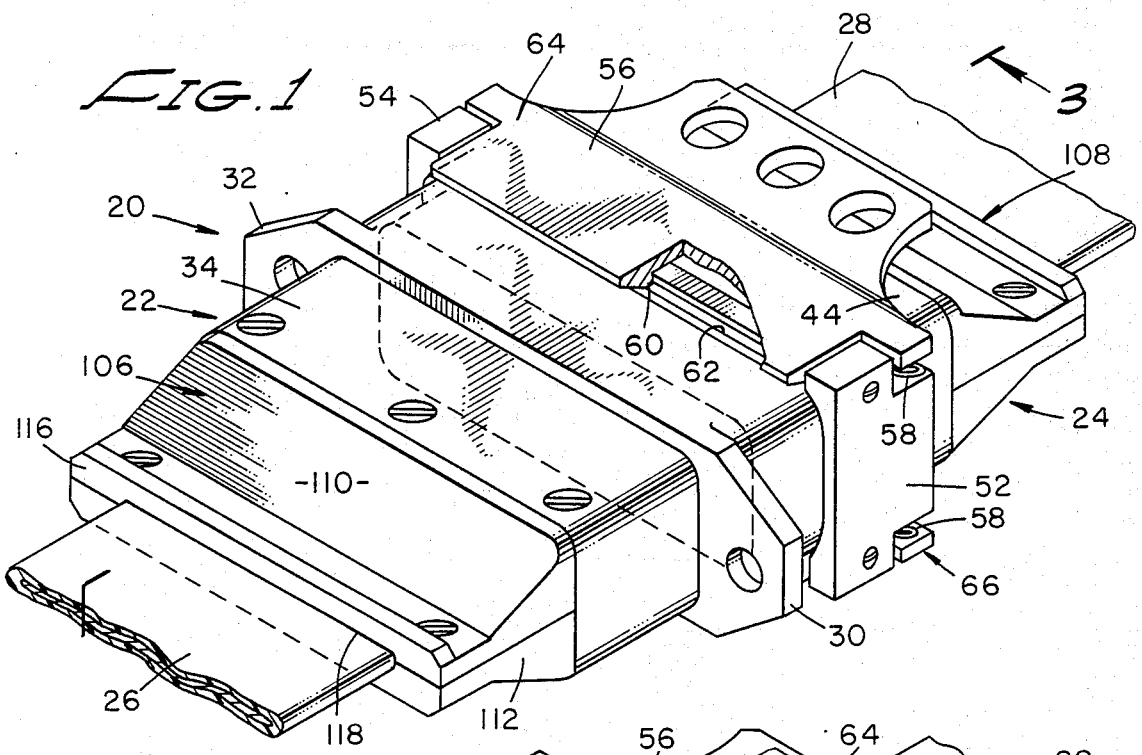
FIG. 1 is a perspective view of the electrical connector of the present invention shown fully mated.

For the ensuing detailed description of the present invention, reference is now made to the drawings and particularly to FIG. 1 where the fully mated electrical connector of this invention enumerated generally as 20 is depicted. In its major parts, the connector consists of a first connector part 22, which will also be referred to as a receptacle, and a second connector part 24 referred to sometimes herein as a plug. These parts can be selectively mated in order to effect electrical interconnection between flat cables 26 and 28. The receptacle is seen to include flanges 30 and 32 extending outwardly from the main connector part housing for enabling mounting to equipment or wall surfaces, for example, to provide a fixed orientation.

Referring now simultaneously to FIGS. 2 through 5, the receptacle housing 34 is seen to consist of an open-ended shell which is generally rectangular in cross section. As can be seen best in FIG. 3, the internal cavity is of uniform cross-sectional dimensions at the cable end and expands outwardly to a larger internal cross-sectional portion 36 at the end through which the plug is received on mating. The end portion 38 of the housing inner wall surfaces are tapered or flared outwardly immediately adjacent its outer end serving as a ramp to assist in alignment of the connector parts during mating. At the point of juncture between the larger cross-section chamber 36 and the smaller one 40, there is an internal shoulder 42. As can be seen best in FIGS. 2, 4 and 5, the internal cavity of the receptacle shell is generally rectangular in cross-section with radiused internal corners.

Figure 3:
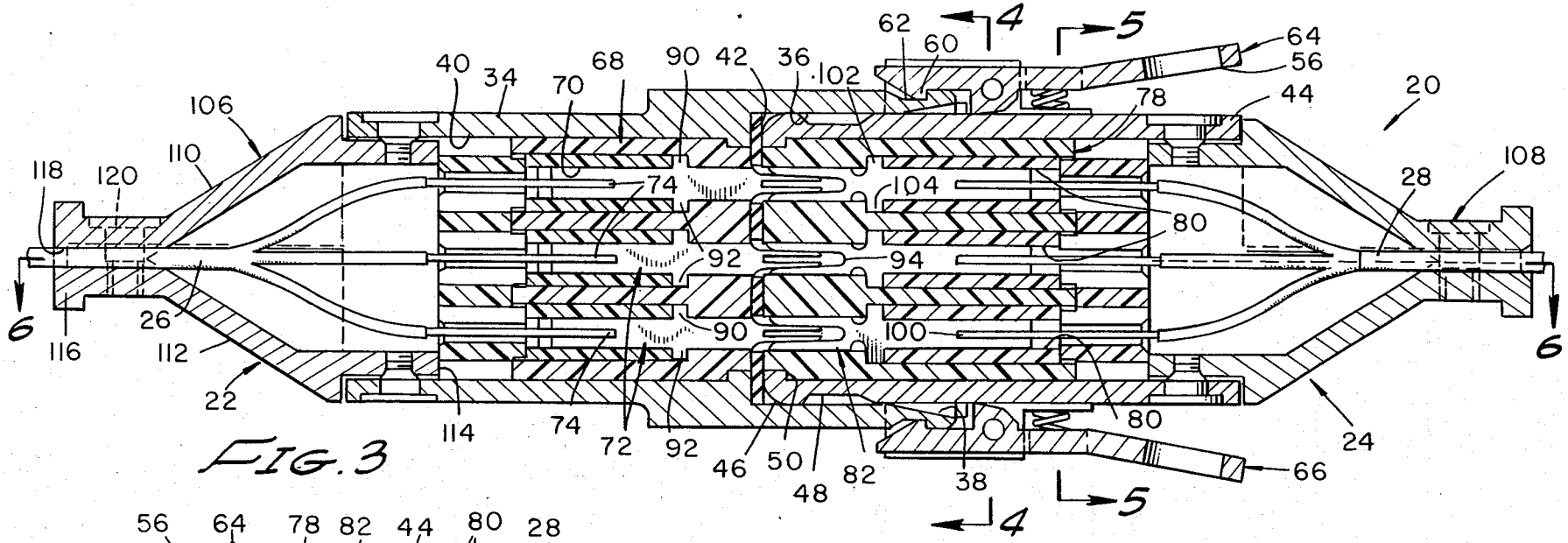
FIG. 3 is a sectional, elevational view taken along the line 3—3 of FIG. 1.
Figure 5:
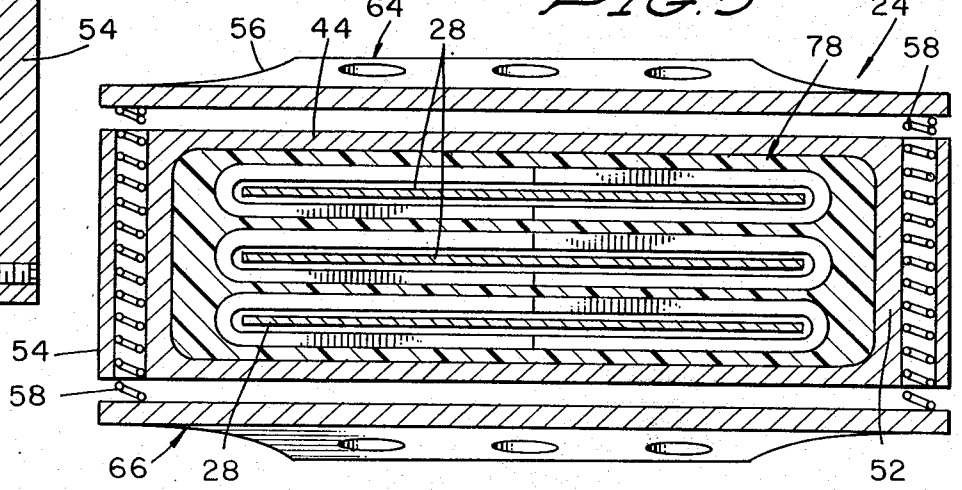
FIG. 5 is a further transverse elevational view taken along the line 5—5 of FIG. 3.
Figure 4:
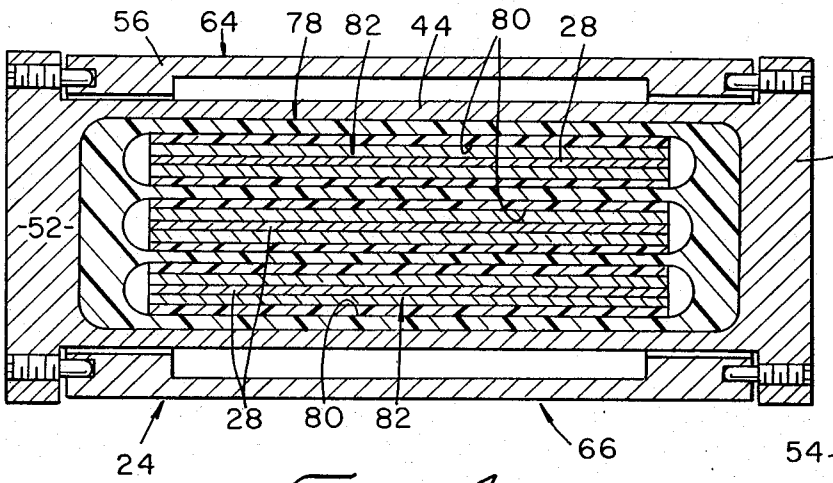
FIG. 4 is a transverse elevational, sectional view taken along the line 4—4 of FIG. 3.
Figure 6:
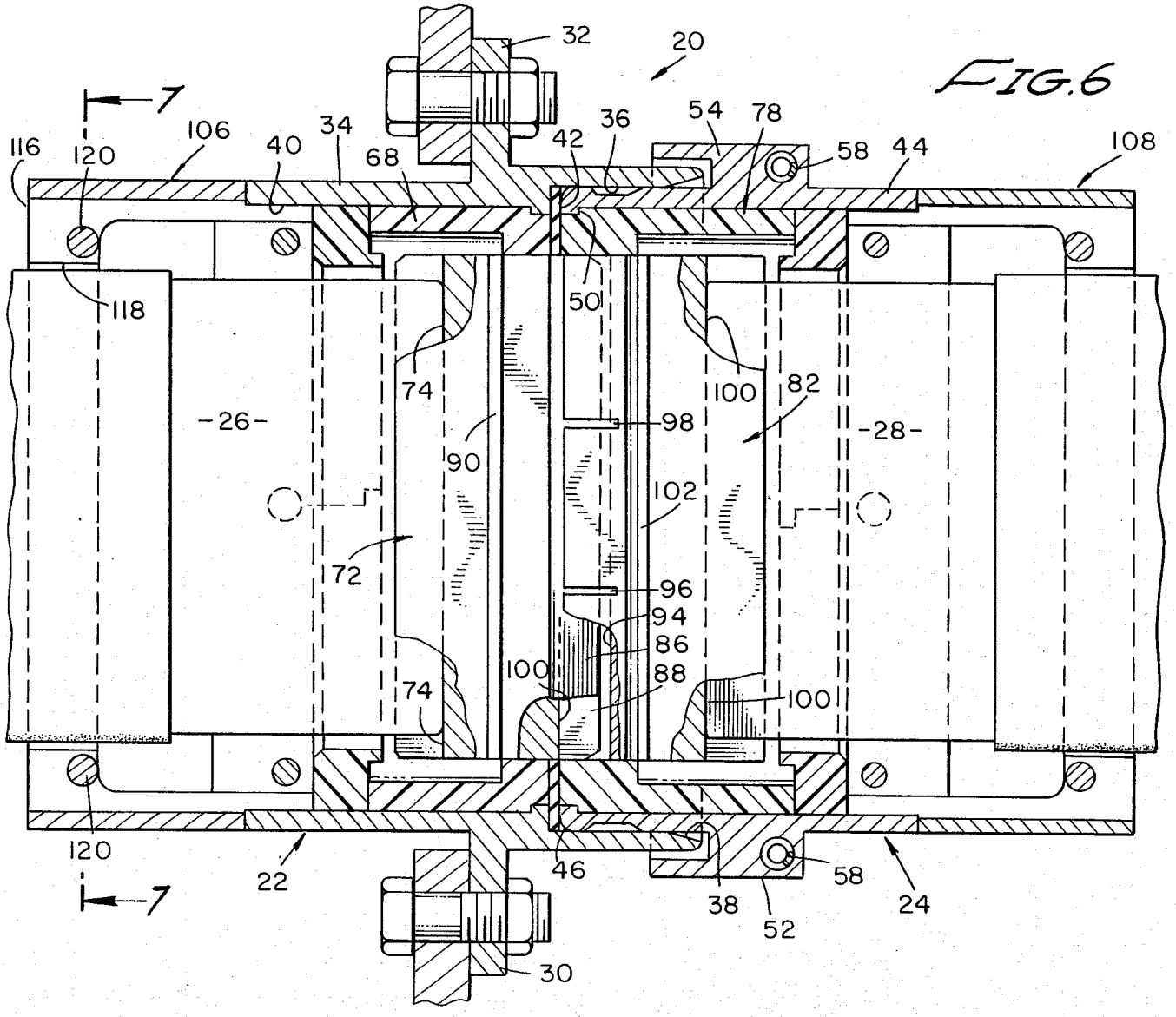
FIG. 6 is a top plan sectional view taken along the line 6—6 of FIG. 3.
Figure 7:
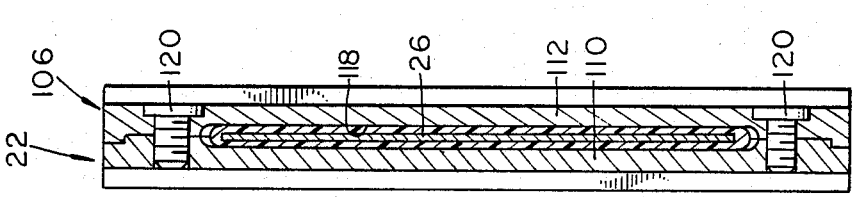
FIG. 7 is a transverse sectional, elevational view taken through the flat cable along line 7—7 of FIG. 6.

The plug shell 44 is of similar construction to the receptacle shell 34 in being a generally one-piece hollow metal shell with a rectangular cross-section and which is open at both ends. The shell forward end, namely the end which is received within the receptacle on mating, is so dimensioned as to provide a sliding fit within the larger cavity cross-section portion 36 of the receptacle shell (FIG. 3). The end portion corners of the plug shell are radiused at 46 and just back of the end portion is a circumferentially extending groove 48. Rearwardly of the shell forward end is an internal corner 50 which is utilized as a retention means in a manner to be described.

Figure 2:
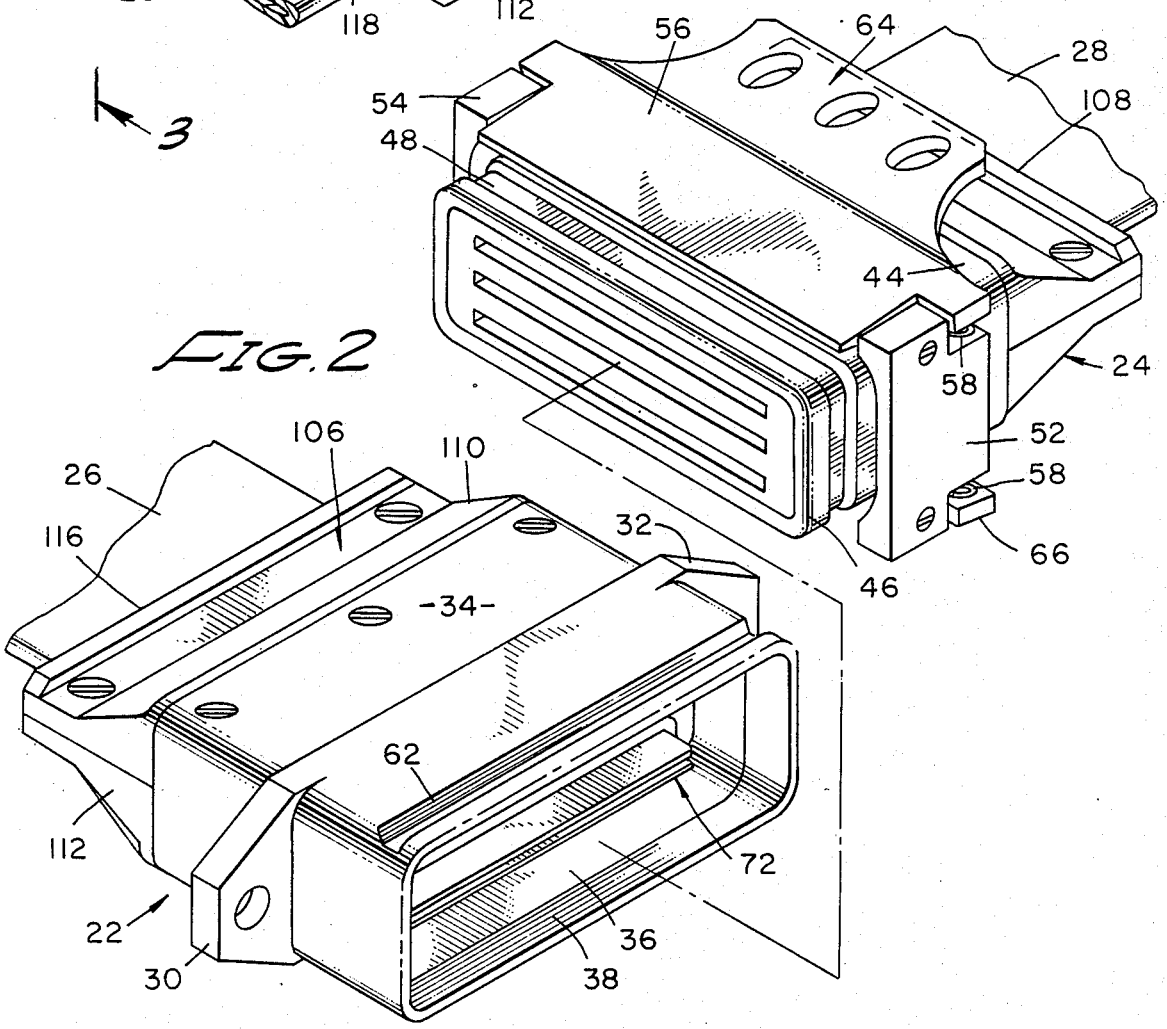
FIG. 2 shows a perspective view of the electrical connector of FIG. 1 with the connector parts unmated.

Returning for the moment to FIG. 1, a pair of block mounts 52 and 54, respectively, are secured to opposite sides of the plug shell 44 by threaded means, for example. A rotatable latch plate 56 has its end portions journaled to the mounts 52 and 54 and an edge of the plate is resiliently urged by springs 58 toward the plug shell. The inner surface of the latch plate has a detent 60 which is so dimensioned as to fit into a groove 62 formed in an outer surface of the receptacle shell (FIGS. 1 and 2). When the two shells (or connector parts) are fully mated together, the detent 60 is located within the associated groove 62 on the receptacle producing locking engagement between the plug and receptacle. Operation is such that the locking means is placed in the locking mode automatically upon joining or mating of the connector parts. To release the connector parts, it is necessary to press the two latch plates toward the plug connector thereby moving the detents from the receptacle grooves. Although the detailed construction of only the locking means enumerated as 64 has been given, there is a second identically constructed locking means 66 on the opposite side of the connector part.

The receptacle shell internal cavity portion 40 includes an electrically insulative insert 68 having a plurality of slot-like openings 70, one for each electrical contact, having their major surface areas forming planes which are parallel to similar major surface area portions of the receptacle shell. Within each opening 70 there is located an electrical contact, which, although it may be either the male or female variety to be described, for illustrative purposes it is shown as a male contact 72. The rearwardly facing edge of each contact 72 includes a slot 74 for receiving an end of a cable wire 26 within which may be soldered in place. Typically, the contacts with wires already crimped or soldered therein will be located within the insert 68 by rearward implacement utilizing special tools for this purpose.

Still referring to FIG. 3, the plug shell 44 includes an electrically insulative insert 78 fittingly received therein which has a plurality of internal openings 80 of slot-like geometry, extending longitudinally of the plug body and so arranged as to be individually aligned with openings 70 in the receptacle insert upon mating of the conductors. A female electrical contact 82 is located in each of the insert openings with the female portions facing toward the open end for engaging with the male connector contacts.

Figure 8:
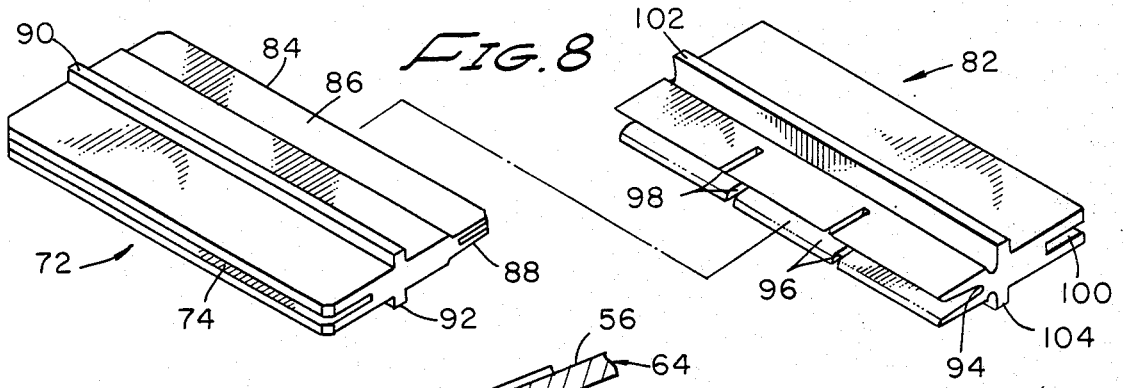
FIG. 8 is a perspective view of male and female contacts used in the connector of this invention.

FIG. 8 depicts the male and female electrical contacts 72 and 82, respectively, which are specifically constructed for use in the present connector and for interconnection with flat cable conductors having a generally rectangular cross-section with a width at least several times its thickness.

The male connector 72 is of generally plate-like construction having a width substantially equal to or slightly greater than the width of the flat cable conductor 26. One of its long edges includes a slot 74 extending the full width of the contact and is of such dimensions as to enable fitting receipt of the flat cable conductor therein, the latter then being secured in an electrically conductive manner to the contact by soldering, for example. The opposite edge portion 84 includes a pair of spaced apart blades 86 and 88 the outermost surfaces of which taper to a minimum overall dimension at the blade outer edges. The outer edges of the blades are radiused. Substantially midway between the double-blades and slotted edge are flanges 90 and 92 extending, respectively, from the two major plate surfaces.

The female contact 82 is also of generally plate-like construction having an overall length which corresponds to the width, or slightly greater, of the flat cable conductor. A forward or leading edge of the contact has a V-shaped cavity or groove 94 extending throughout its complete length which bottoms in a radiused corner. The two side walls defining the V-shaped groove include first and second spaced apart slots 96 and 98 which extend transversely of the V-shaped slot axis and serve to form the side walls into a plurality of resilient members which can individually flex responsive to bending forces on mating with a male contact. The opposite edge of the contact includes a slot 100 within which the flat cable conductor is received and soldered in place. Mounting flanges 102 and 104 extend from opposite major surfaces of the contact intermediate the V-shaped cavity and the cable receiving slot. As in the receptacle, the female contacts 82 are mounted within the insulative insert openings 80 and interconnection of cable wires 28 to the contacts is made in the same way as for the male contacts.

For the ensuing description of the connector backshells 106 and 108, simultaneous reference is made to FIGS. 1 and 3. Since the two backshells are identical, only backshell 106 will be discussed in detail. First and second identically shaped half-shells 110 and 112 fit together to provide a generally tapering housing and an enclosed cavity with a relatively large rectangular end 114 which is so dimensioned as to fit within the connector part end over the cable. The opposite or small end 116 has a slot 118 just large enough to accommodate the cable with its insulation on. The backshells are secured in place to the connector part and cable by a plurality of threaded means 120, for example. As with other more conventional backshells, the backshells 106 and 108 protect the otherwise open connector part ends, provide substantial EMI shielding, and effect cable strain relief.

Figure 9:
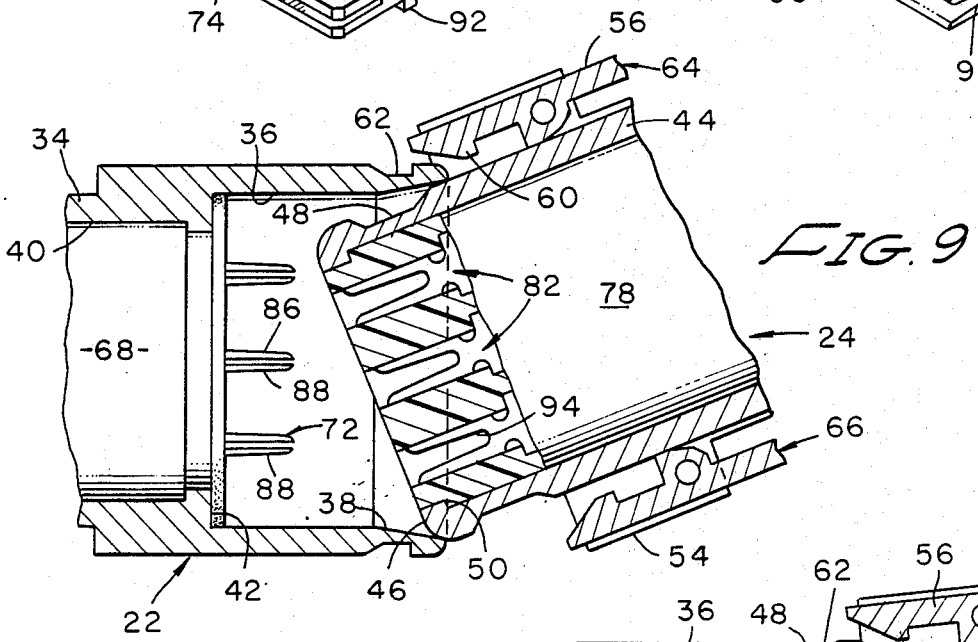
FIG. 9 is a side elevational, sectional view of the leading edges of the two connector parts showing attempted mating along an extreme angle of misalignment.
Figure 10:
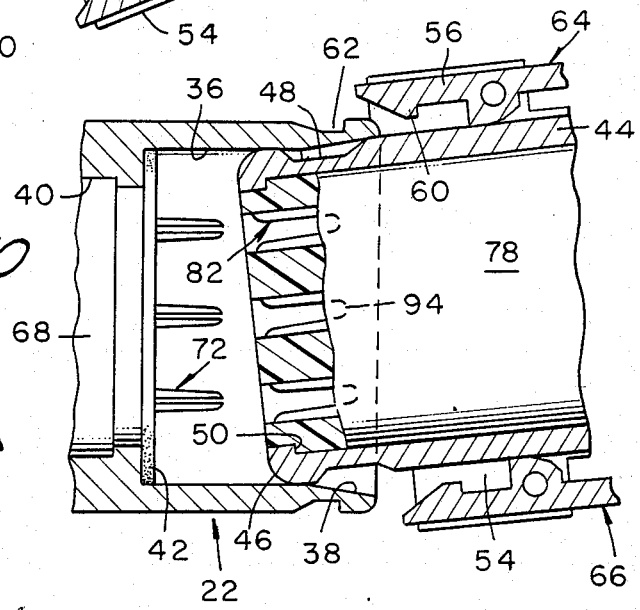
FIG. 10 shows the misalignment mating just after initial force has been applied to the connector parts.
Figure 11:
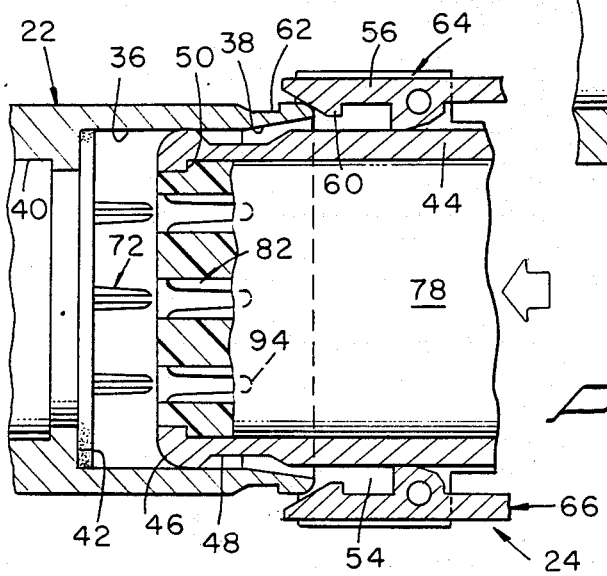
FIG. 11 shows the connector parts just prior to actual mating of the contacts.

As alluded to earlier, an advantageous aspect of the described electrical connector is the ability to quickly and easily mate the connector parts even when the parts are misaligned when engagement is attempted. FIG. 9 shows an initial misalignment in which the plug is rotated about an axis parallel to one of its two major surfaces so that the plug radiused lower edge 46 contacts the receptacle opening lower edge, and the opposite opening edge contacts the plug upper surface rearwardly of the circumferential groove 48. Further mating force applied to the connector parts cams the parts toward alignment (FIG. 10) and then still further force brings full alignment (FIG. 11) followed by mating engagement. The radiused, but knifelike, forward edges of the male contact blades also act to enable receipt of a male contact within the female even though somewhat misaligned and then align on mating without risking damage to the contacts. It is important to note that at no time during the mating process can the male contacts be shorted out to the plug housing shell 44, or to another incorrect female contact.

Figure 12:
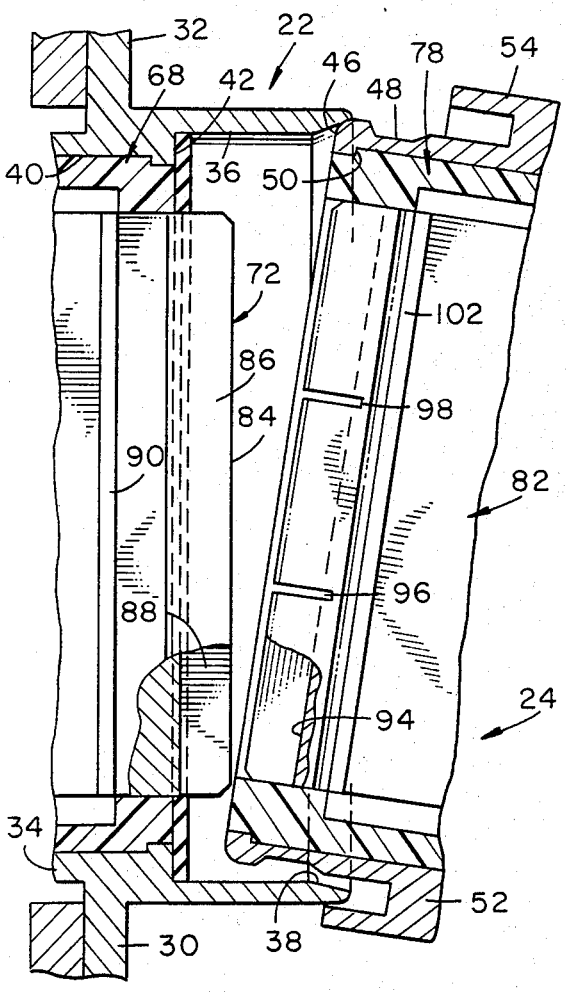
FIG. 12 is a top plan sectional depiction of an attempted mating where there has been misalignment in a plane 90 degrees to that of FIG. 9.
Figure 13:
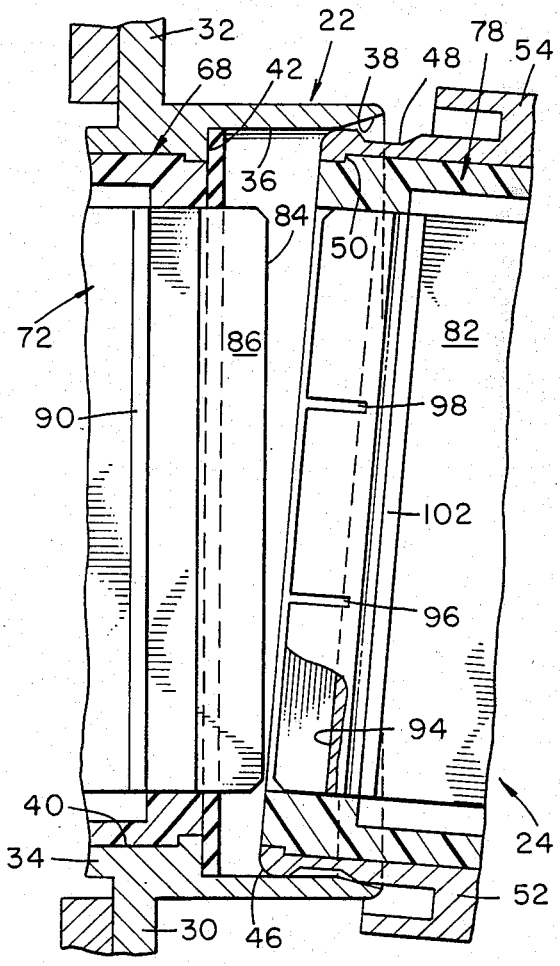
FIG. 13 shows the alignment action of the connector housing after further force is applied from that position shown in FIG. 12.
Figure 14:
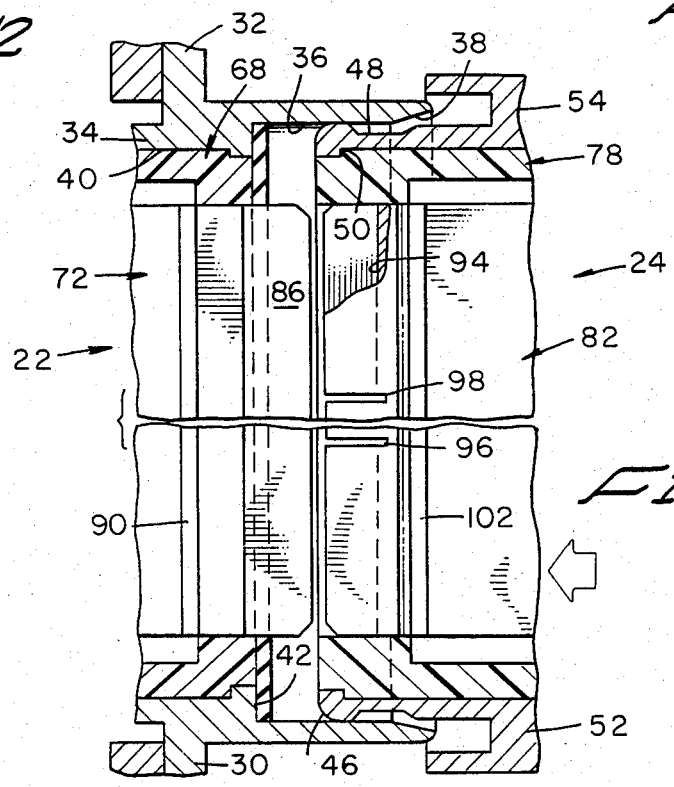
FIG. 14 is a view similar to FIGS. 12 and 13 with connector parts substantially mated.

FIG. 12 shows attempted mating where the plug is rotated angularly about an axis orthogonal to a plug major surface area from precise mating alignment. One plug radiused edge 46 contacts the inner surface of the receptacle opening and the opposite plug peripheral surface engages the receptacle edge substantially rearwardly of the plug radiused end portion. As mating force is applied the parts are progressively brought into alignment until final mating is achieved. As before there is no shorting-out of the contacts, nor damage to them because of misalignment.

Although the advantages of the invention in mating with misaligned parts have been described, these same advantages accrue when disengagement or unmating is accomplished and the separating parts are skewed or misaligned.

What is claimed is:

1. An electrical connector having plug and receptacle parts which can be mated or unmated by force application directed along lines within a substantial angular range, comprising:

an open-ended hollow metal receptacle shell of generally rectangular cross-section with sidewalls forming the width being longer than those forming the height, and an inner edge portion surface being tapered;

a first insulative insert received within the receptacle shell having at least one slotlike opening therein, the plane of which is parallel to the sidewalls forming the receptacle shell width;

a first thin generally flat platelike contact received within the insert opening and extending parallel to the shell sidewalls forming the shell width;

an open-ended hollow metal plug shell of generally rectangular cross-section with sidewalls forming the width being longer than those forming the height, the cross-section dimensions of one end portion of said plug shell being capable of sliding receipt within an open end of the receptacle shell, an open end outer surface of said plug shell being positively radiused and provided with a groove spaced slightly from the radiused end that completely encircles the plug shell;

a second insulative insert received within the plug shell and having at least one slotlike opening therein with its plane parallel to the plug shell sidewalls forming the plug shell width; and a second thin generally flat platelike contact complementary with the first contact, located within the plug insert opening and extending parallel to the plug shell sidewalls forming the plug shell width, wherein when the first and second contacts are fully mated they lie in the same place.

2. A connector as in claim 1, in which the first platelike contact has a pair of spaced apart blades, and the second platelike contact includes a V-shaped slot for receiving the blades of the first contact therein upon mating of the plug shell with the receptacle shell.

3. A connector as in claim 2, in which the first contact blades are compressed toward one another during receptacle and plug shell mating.

4. A connector as in claim 1, in which the receptacle shell includes first and second grooves formed in the shell outer surfaces adjacent said shell open end on respective opposite sides of said shell; and first and second spring-loaded latch plates mounted on opposite sides of the plug shell, each latch plate having parts for being positioned within a respective groove in the receptacle shell on mating of the receptacle and plug shells.

* * * * *